US005181391A

United States Patent [19]

Manz

[11] Patent Number: 5,181,391

[45] Date of Patent: Jan. 26, 1993

[54] REFRIGERANT HANDLING SYSTEM WITH AIR PURGE AND MULTIPLE REFRIGERANT CAPABILITIES

[75] Inventor: Kenneth W. Manz, Paulding, Ohio

[73] Assignee: SPX Corporation, Muskegon, Mich.

[21] Appl. No.: 844,559

[22] Filed: Mar. 2, 1992

[51] Int. Cl.[5] ..... F25B 45/00

[52] U.S. Cl. ..... 62/129; 62/195; 62/475

[58] Field of Search ..... 62/125, 126, 127, 129, 62/85, 195, 149, 292, 475

[56] References Cited

U.S. PATENT DOCUMENTS

| | | | |
|---|---|---|---|
| 2,324,627 | 7/1943 | Jones | 62/127 X |
| 2,451,072 | 10/1948 | Cooper | 62/127 |
| 2,475,218 | 7/1949 | Campbell | 62/475 X |
| 2,612,760 | 10/1952 | Baggette et al. | 62/127 |
| 4,805,416 | 2/1989 | Manz et al. | 62/292 |
| 4,939,905 | 7/1990 | Manz | 62/149 X |
| 5,005,369 | 4/1991 | Manz | 62/195 |
| 5,063,749 | 11/1991 | Manz | 62/149 |

*Primary Examiner*—Harry B. Tanner

*Attorney, Agent, or Firm*—Barnes, Kisselle, Raisch, Choate, Whittemore & Hulbert

[57] ABSTRACT

A refrigerant handling system that includes a liquid refrigerant storage container and a pump for feeding refrigerant in liquid phase to the container so that any air in the container or carried by the circulating refrigerant is captured within the container over the refrigerant. A bulb containing a reference refrigerant (R12) is positioned in heat transfer relation with refrigerant fed to the container. A pressure gauge is coupled to the bulb and calibrated to indicate saturation temperature of the reference refrigerant, and thereby reflect actual temperature of refrigerant in the container. A differential pressure gauge has separate scales for multiple refrigerant types (R22, R134a, R500, R502) to indicate apparent refrigerant temperature as a function of any bulb/container pressure differential. A valve is coupled to the container for venting air therefrom when apparent refrigerant temperature exceeds actual refrigerant temperature for the specific refrigerant type under service.

15 Claims, 3 Drawing Sheets

REFRIGERANT HANDLING SYSTEM WITH AIR PURGE AND MULTIPLE REFRIGERANT CAPABILITIES

The present invention is directed to refrigerant handling systems, and more particularly to a device for purging air from within a liquid refrigerant storage container.

BACKGROUND AND OBJECTS OF THE INVENTION

U.S. Pat. No. 5,005,369, assigned to the assignee hereof, discloses a refrigerant recovery and purification system that includes a compressor having an inlet coupled through an evaporator and a solenoid valve to the refrigeration equipment from which refrigerant is to be recovered, and an outlet coupled through a condenser to a refrigerant storage container or tank. Refrigerant may be withdrawn from the storage container and pumped, either by the compressor or by a separate liquid refrigerant pump, through a filter/drier for removing water and other contaminants, and then returned to the storage container. A pressure differential valve receives a first pressure input from a refrigerant bulb positioned for heat exchange with refrigerant fed to the storage container, and thus indicative of temperature of refrigerant within the container itself. A second input to the valve is indicative of refrigerant/air vapor pressure within the container. The valve is coupled to a purge port on the container for automatically venting air from within the container when the pressure differential between the valve input ports exceeds the threshold setting of the valve. In a modified embodiment, a differential pressure gauge receives the first pressure input indicative of refrigerant temperature and the second input indicative of refrigerant/air vapor pressure within the container, and a manual valve is coupled to the container purge port for manipulation by an operator when the gauge indicates excessive pressure differential.

U.S. Pat. No. 5,063,749, also assigned to the assignee hereof, discloses a refrigerant handling system having both air purge and multiple refrigerant capabilities. A refrigerant bulb is positioned for heat exchange with refrigerant fed to the storage container as in the earlier patent. A double-needle pressure gauge has a first port coupled to the refrigerant bulb and a second port coupled to the container. The gauge needles thereby indicate vapor pressure of refrigerant fed to the container and refrigerant/air vapor pressure within the container. The gauge is provided with multiple scales calibrated for differing types of refrigerant, so that an operator knowing the type of refrigerant under service may observe the gauge, determine the pressure differential between the container refrigerant/air vapor pressure and the refrigerant saturation pressure, and manually purge air from within the container when such pressure differential exceeds the desired level.

Although the inventions disclosed in the above-noted patents address and overcome problems theretofore extant in the art, further improvements remain desirable. For example, although the automatic and manual air purge techniques disclosed in U.S. Pat. No. 5,005,369 operate well for a specific type of refrigerant, this technique is not well suited for use in conjunction with multiple refrigerants because the refrigerant/air vapor pressure in the storage container does not compare with the saturation pressure within the bulb properly to indicate partial pressure of air within the container unless the refrigerant in the bulb is of the same type as that in the container. The invention of U.S. Pat. No. 5,063,749 provides such multiple refrigerant capability, but has the disadvantage that comparison of two needle readings is required, and that the coaxially mounted bourdon tube gauge produces additive error in the two gauge readings.

It is therefore a general object of the present invention to provide a refrigerant handling system with air purge capability that exhibits improved accuracy as compared with the systems disclosed in the '749 patent, and/or that is capable of handling multiple differing types of refrigerants as compared with the systems disclosed in the '369 patent. Another object of the present invention is to provide a refrigerant handling system with both air purge and multiple refrigerant capabilities in which the air purge gauge can assist an operator in identifying the type of refrigerant under service and/or an empty storage container.

SUMMARY OF THE INVENTION

A refrigerant handling system in accordance with the present invention includes a liquid refrigerant storage container and a pump (which may be a compressor) for feeding refrigerant in liquid phase to the container so that any air carried by the refrigerant is captured within the container over the refrigerant. A first gauge provides an indicator of actual temperature of refrigerant within the container. A second gauge is responsive to actual refrigerant/air vapor pressure within the container to provide an indication of apparent refrigerant temperature within the container as a function of such refrigerant/air vapor pressure and the saturation pressure/temperature characteristics of the specific type of refrigerant under service. In effect, the second gauge assumes that the refrigerant/air vapor pressure reflects refrigerant saturation pressure with no air partial pressure, and indicates corresponding saturation temperature. Any difference between the two temperature readings thus reflects the partial pressure of air within the container, which may be vented.

In the preferred embodiments of the invention, the second gauge comprises a pressure differential gauge that receives a first pressure input indicative of a reference refrigerant saturation pressure at the temperature of the refrigerant within the storage container, and a second pressure input indicative of actual refrigerant/air vapor pressure within the storage container. The second gauge has scales coordinated with refrigerant saturation pressure differential between the first and second ports versus refrigerant temperature. Thus, the second gauge in effect reads a temperature that reflects a difference between the container refrigerant/air vapor pressure and the reference refrigerant saturation pressure at the container refrigerant temperature. Any difference between such temperature reading on the second gauge and the actual container refrigerant temperature reading on the first gauge is therefore due to partial pressure of air within the container. An operator may thus visually compare the gauge temperature readings, and manually open an air purge valve coupled to the container when the temperature indicated on the second gauge exceeds that indicated on the first gauge.

In the preferred embodiments of the invention, a refrigerant bulb containing a reference refrigerant of first predetermined type, such as R12 refrigerant, is disposed in heat transfer relation to refrigerant fed to the storage container. The saturation pressure of the reference refrigerant within the bulb is thus indicative of temperature of refrigerant being fed to the container, and is considered to reflect actual temperature of refrigerant within the container under steady-state conditions. The differential pressure gauge includes a single needle whose position varies as a function of pressure differential between the container and the refrigerant bulb, and multiple scales associated with differing types of refrigerant. Each scale is calibrated in units of temperature as a function of the difference in saturation pressures between the associated refrigerant type and the reference refrigerant contained within the bulb. Each scale thus yields a temperature reading that relates actual refrigerant/air vapor pressure within the container compared to saturation temperature of the reference refrigerant within the bulb, while the first gauge directly reads temperature of refrigerant being fed to and contained within the container. In the preferred embodiments of the invention, the differential pressure gauge scales are calibrated for R22, R134a, R500 and R502 types of refrigerant versus R12 as a reference refrigerant.

The first gauge that reads actual refrigerant temperature may comprise a pressure gauge coupled to the reference refrigerant bulb and calibrated in units of saturation temperature of the reference refrigerant—e.g., R12. In a second embodiment, the temperature-indicating pressure gauge may be coupled to the container purge port and calibrated to indicate container refrigerant temperature as a function of refrigerant/air vapor pressure. This, technique is less accurate than the preferred technique discussed immediately above, but is also less expensive. Alternatively, and still less expensive, the temperature gauge may comprise an inexpensive thermometer and a thermometer well adapted removably to receive the thermometer for bringing the thermometer into heat transfer relation with refrigerant being fed to the storage container.

BRIEF DESCRIPTION OF THE DRAWINGS

The invention, together additional objects, features and advantages thereof, will be best understood from the following description, the appended claims and the accompanying drawings in which:

DETAILED DESCRIPTION OF PREFERRED EMBODIMENTS

Figure 1:
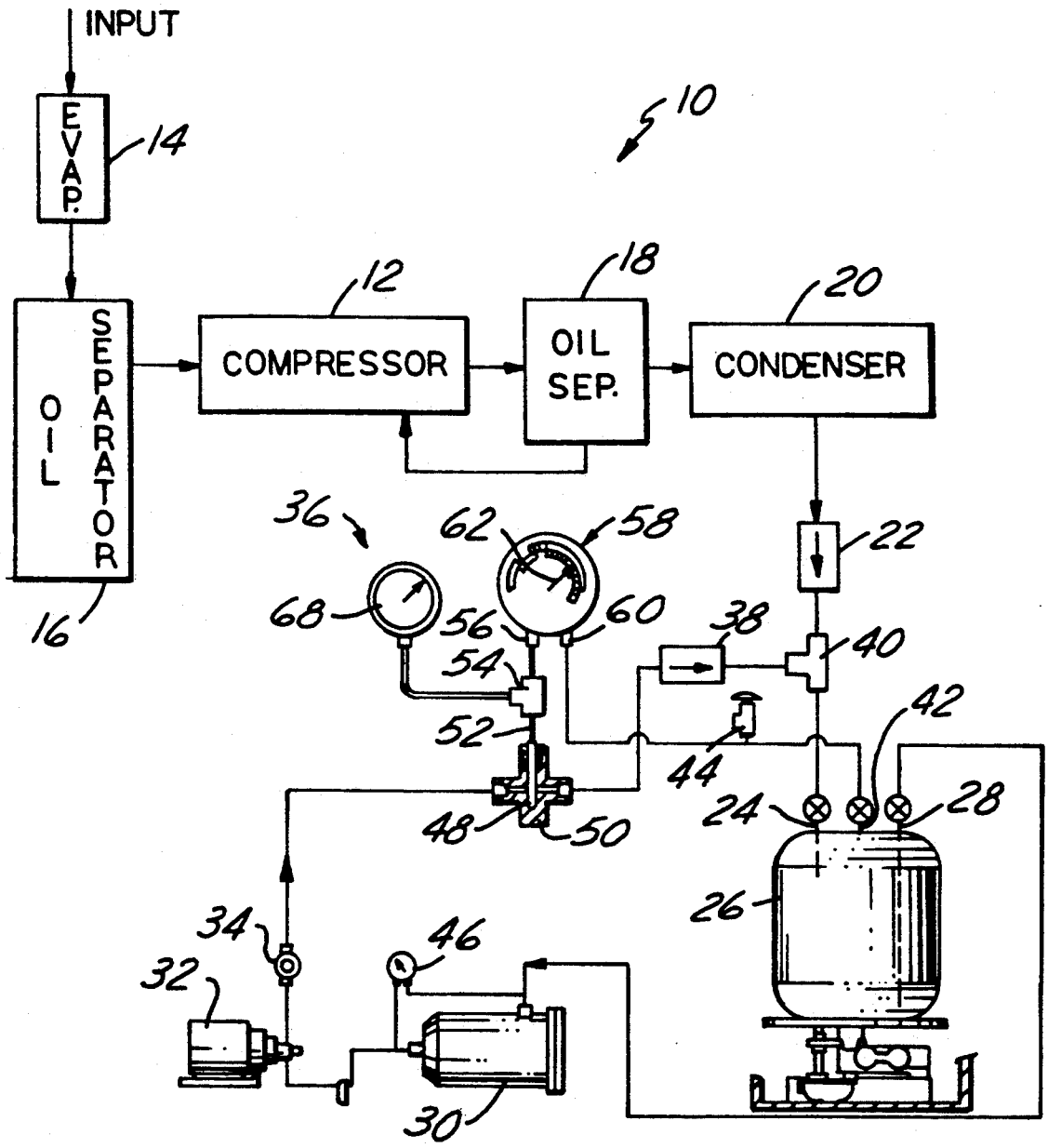
FIG. 1 is a schematic diagram of a refrigerant recovery and purification system in accordance with one exemplary embodiment of the invention.

FIG. 1 illustrates a refrigerant recovery and purification system 10 as comprising a compressor 12 having an inlet that is coupled through an evaporator 14 and an oil separator 16 to receive input refrigerant from refrigeration equipment under service. The outlet of compressor 12 is connected through a compressor oil separator 18, a condenser 20 and a check valve 22 to the vapor port 24 of a refrigerant storage container 26. The liquid port 28 of container 26 is connected through a filter/drier 30, a liquid refrigerant pump 32, a sight glass/moisture indicator 34, an air purge system 36 and a check valve 38 to a tee 40 at port 24. The purge port 42 of container 26 is connected to air purge system 36 through a manual air purge valve 44. A differential pressure gauge 46 is connected across filter/drier 30 for indicating operative condition of the filter cartridge contained therewithin, and thereby indicating to an operator when the filter cartridge should be changed.

To the extent thus far described—i.e., with the exception of details of air purge system 36 yet to be described—the recovery and purification system 10 of FIG. 1 is essentially the same as those disclosed in the above-referenced patents. Refrigerant is recovered from equipment under service by connection of evaporator 14 thereto, and by operation of compressor 12 to draw the refrigerant from the equipment under service and pump such refrigerant to vapor port 24 of container 26. Following recovery of such refrigerant, or simultaneously with the recovery operation, liquid pump 32 may be operated to draw refrigerant from liquid port 28 of container 26, pump such refrigerant through filter/drier 30 and return the refrigerant to the storage container. Alternatively, as disclosed in U. S. Pat. No. 4,805,416, compressor 12 may be utilized for recycling and purifying the refrigerant within container 26 by connecting port 28 to evaporator 14 through an expansion valve or the like. In such a modification, air purge system is connected between condenser 20 and container 26. The disclosures of U.S. Pat. No. 4,805,416 is incorporated herein by reference for purposes of such background discussion.

Figure 2:
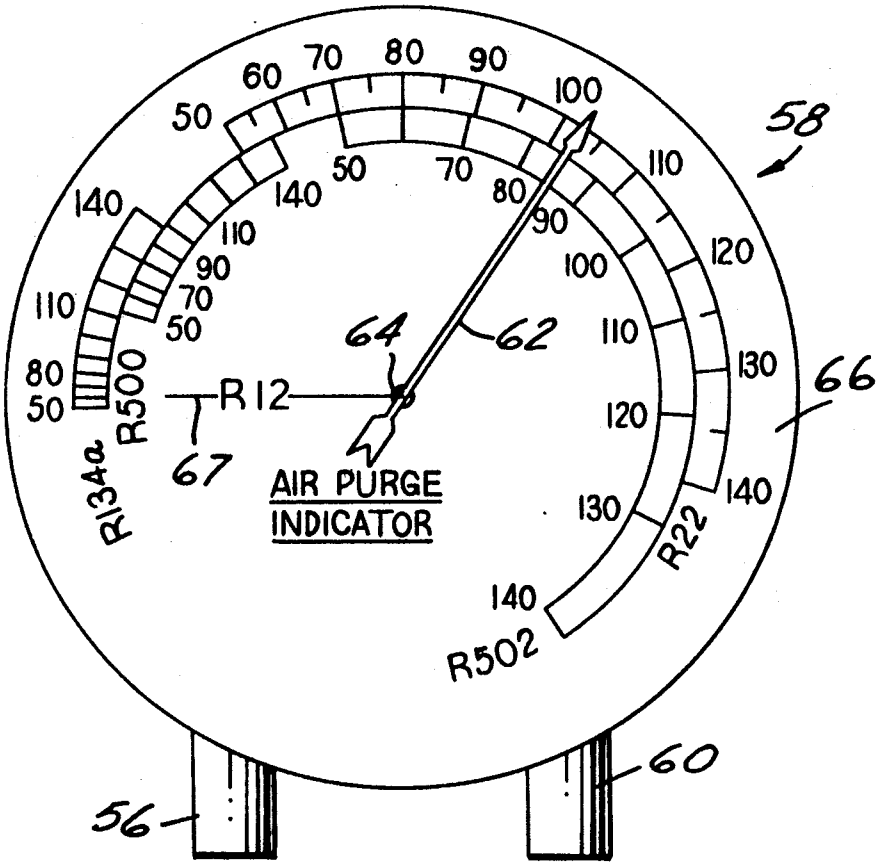
FIG. 2 is a front elevational view on an enlarged scale of the differential pressure gauge illustrated schematically in FIG. 1.

In accordance with the present invention, air purge system 36 illustrated in FIG. 1 includes a reference refrigerant bulb 48 positioned within a fitting 50 that is disposed in the liquid refrigerant flow path between pump 32 and container 26. Bulb 48 is filled with a predetermined reference refrigerant type, such as R12 refrigerant. Bulb 48 is connected by a line 52 through a tee 54 to one input 56 of a differential pressure gauge 58 (FIGS. 1 and 2). The other input port 60 of gauge 58 is connected to purge port 42 of container 26 along with manual purge valve 44. Thus, the pressure input to port 56 from bulb 48 is equal to the saturation temperature of the reference refrigerant contained within bulb 48 at the temperature of the refrigerant (of whatever type) being fed to container 26, which is considered to reflect the temperature of refrigerant within container 26 under steady-state conditions. The pressure input at gauge port 60 is equal to the refrigerant/air vapor pressure within container 26. A pressure gauge 68, which is calibrated to read saturation temperature of the R12 reference refrigerant within bulb 48, is connected to line 52 at tee 54.

Gauge 58 includes a needle 62 that rotates about a fixed axis 64 (FIG. 2) as a function of pressure differential between gauge ports 56, 60. A plurality of scales are printed on the faceplate 66 of gauge 58 circumferentially around the axis 64 of needle rotation. Each scale is calibrated, as shown in FIG. 2, in units of temperature as a function of saturation pressure differential between a specific type of refrigerant associated with that scale and the reference refrigerant contained within bulb 48 (FIG. 1). Thus, one scale identified as "R134a" is calibrated to read temperature between 50° F. and 140° F. The second scale "R500" is circumferentially staggered clockwise from the "R134a" scale, and is likewise calibrated to indicate temperature between 50° F. and 140° F. The third scale staggered circumferentially clockwise from the "R500" scale is associated with the legend "R22", and the fourth scale staggered clockwise from the "R22" scale is associated with the legend "R502". These scales are likewise calibrated in the temperature range 50° F. to 140° F. A base line 67 at approximately the nine o'clock position of gauge 58 is associated with "R12" refrigerant. The scales on gauge faceplate 66 are preferably colored blue for R134a, green for R22, yellow for R500 and purple for R502, which refrigerant/color coordination is widely used in the refrigeration industry.

Figure 3:
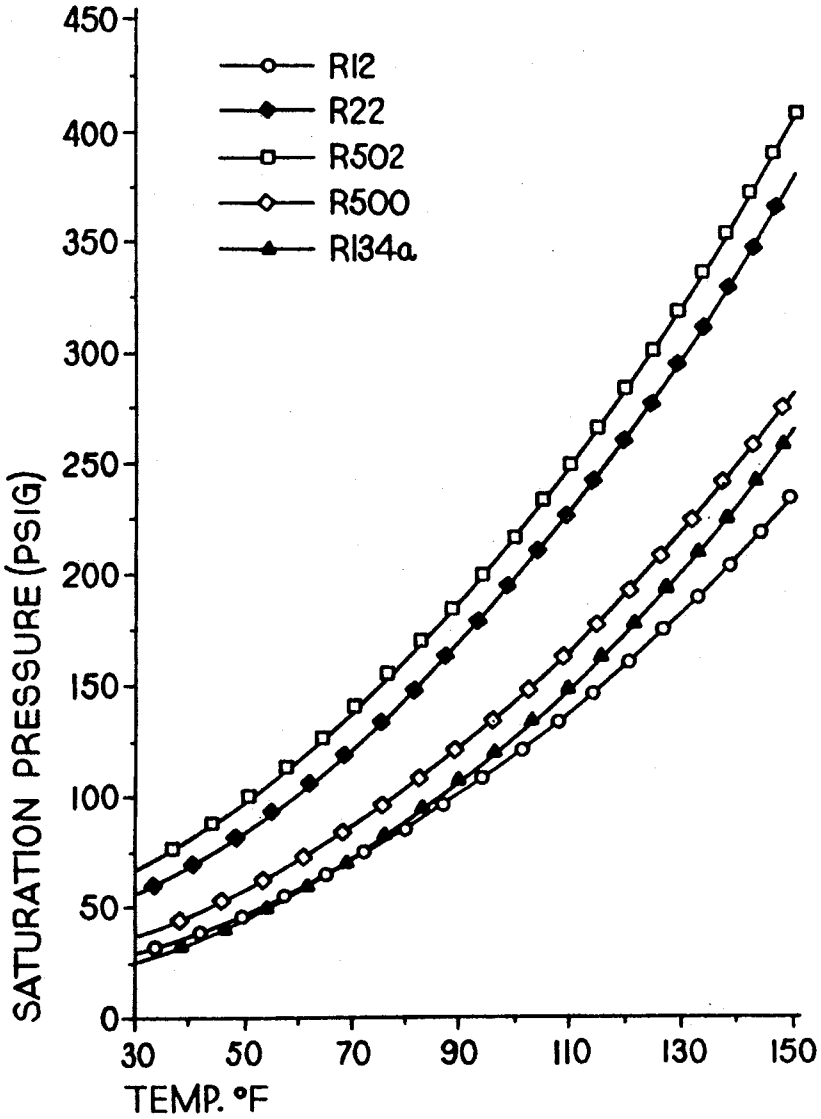
FIG. 3 is a graph that illustrates refrigerant saturation pressure versus temperature for multiple differing refrigerant types.

The principle of operation of the present invention is to compare the differential pressure between the refrigerant/air vapor pressure in storage container 26 and the saturation pressure of the reference R12 refrigerant in bulb 48, indicated as a temperature on gauge 58, to the expected differential saturation pressure between these refrigerants at the temperature of the refrigerant indicated by gauge 68. FIG. 3 is a graphic illustration of saturation pressure in units of psig versus temperature in units of ° F for each of the refrigerants R12, R22, R500, R502 and R134a. It will be noted that, at any given temperature, there is a specific pressure differential that can be expected between the saturation pressures of any two refrigerants. For example, using R12 refrigerant as a reference, at 90° F. there is a saturation pressure differential of 68.72 psig between R22 and R12, a saturation pressure differential of 87.64 psig between R502 refrigerant and R12 refrigerant, a saturation pressure differential of 20.88 psig between R500 and R12, and a saturation pressure difference of 4.57 psig between R134a and R12. It will also be noted that the pressure differentials to R12 as a reference have partially but not completely overlapping ranges. For example, the R134a/R12 pressure differential between 50° F. and 140° F. ranges from −1.31 psig to 23.23 psig, the R500/R12 differential for the same temperature range is 10.82 to 41.77 psig, the R22/R12 differential for the same temperature range is 37.33 to 131.52 psig, and the R502/R12 differential for this temperature range is 50.69 to 156.67 psig. Since gauge 58 is actually a pressure differential gauge calibrated in units of temperature, this accounts for the staggered scales illustrated in FIG. 2. The temperature range of 50° F. to 140° F. is selected as a typical operating range under normal ambient conditions.

Thus, if the refrigerant temperature within the storage container indicated by gauge 68 (FIG. 1) is 90° F., for example, then gauge 58 (FIG. 2) should read 90° F. on the scale associated with the specific type refrigerant under service (with the exception of R12). If gauge 58 reads a temperature higher than gauge 68 for the specific refrigerant under service, such reading results from the pressure differential between gauge ports 56, 60 associated with partial pressure of air within container 26. Thus, referring again to FIG. 2, and assuming that R22 refrigerant is being serviced, the exemplary gauge reading illustrated in FIG. 2 indicates that the pressure differential between the refrigerant/air vapor pressure within the container and the reference refrigerant saturation pressure within bulb 48 is associated with a refrigerant temperature of approximately 103°. If gauge 68 indicates an actual refrigerant temperature of 90° F., the 13° F. difference reflects air partial pressure within the container. The operator may then open valve 44 until gauge needle 62 moves counterclockwise in FIG. 2 to a temperature reading of 90° F. on the "R22" scale. The reading on gauge 58 for the reference refrigerant—i.e. R12 refrigerant in the preferred embodiment of the invention—without air present in container 26 will be constant since the container pressure and reference bulb saturation pressure would be identical. If R12 refrigerant is being serviced and air is captured within the storage container, needle 62 will be positioned clockwise from the R12 reference line 67 in FIG. 2, and the operator may open the air purge valve 44 until needle 62 aligns with the R12 reference line.

Figure 4:
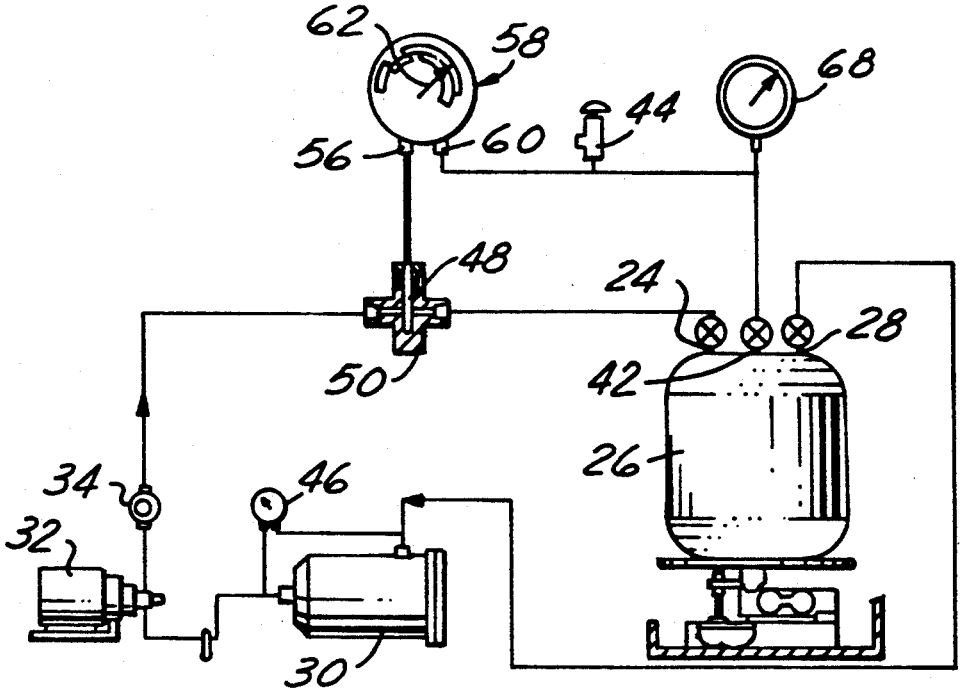
FIGS. 4 and 5 are fragmentary schematic diagrams of respective modifications to the embodiment of the invention illustrated in FIG. 1.
Figure 5:
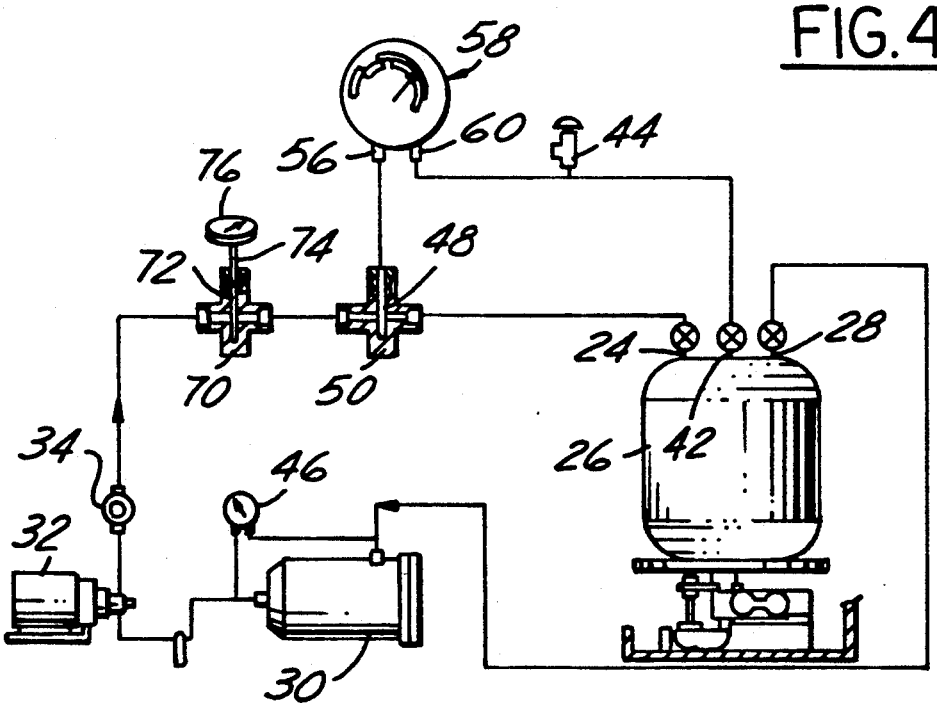

FIGS. 4 and 5 illustrate modifications to the embodiment of the invention shown in FIG. 1. In FIG. 4, pressure gauge 68 calibrated to read R12 saturation temperature is coupled directly to container 26 at air purge port 42. Thus, gauge 68 reads the temperature of refrigerant within container 26 directly, with some small error due to air partial pressure within the container and the differing saturation pressure/temperature characteristics of the differing refrigerants that may be within the container. In FIG. 5, a second fitting 70 is positioned in the liquid refrigerant flow path between pump 32 and container 26. Fitting 70 has a pocket 72 adapted removably to receive the probe 74 of a pocket-type thermometer 76. Pocket 72 is so positioned that probe 74 of thermometer 76 is disposed in heat transfer relation to refrigerant passing through fitting 70, so that the dial on thermometer 76 reads refrigerant temperature directly. The embodiment of FIG. 5 has the advantage of being less expensive than either of the embodiments of FIGS. 1 or 4.

Accuracy of the air purge technique disclosed in the present application is enhanced as compared with the techniques disclosed in the patents noted above. The change in saturation pressure for R502 refrigerant, for example, between 128° and 130° F. is 7.91 psig. However, the R502/R12 differential pressure change is only 3.1 psig for the same 128° to 130° F. temperature change. Furthermore, the scale of gauge 58 may be employed to identify the type of refrigerant under service. The scales on gauge plate 66 are sufficiently different from each other positively to identify the refrigerant type, or that substantial refrigerant mixing has occurred, after an air purge operation. For example, if the operator has purged air from within storage container 26, and if temperature gauge 68 (or 76) indicates a refrigerant temperature of 90° F., then the operator may observe gauge 58, which should also read 90° for the particular type of refrigerant under service. On the other hand, if gauge 58 does not read 90° for any specific type of refrigerant, then it is probable that mixing of refrigerants has occurred within container 26. It will also be recognized that needle 62 of gauge 58 will assume a position counterclockwise of the scales or faceplate 66 if the tank is empty. Thus, the operator can determine that the tank is empty. A pin or spring may be employed to protect the gauge.

I claim:

1. In a refrigerant handling system that includes a first volume and means for feeding refrigerant in liquid phase to said first volume so as to capture air in said volume over the refrigerant, the refrigerant being characterized by a saturation pressure that varies with refrigerant type and temperature, means for purging air captured within said first volume comprising:

first means operatively coupled to said first volume for providing an indication of actual temperature of refrigerant in said first volume, second means operatively coupled to said first volume and responsive to refrigerant/air vapor pressure within said first volume for providing an indication of an apparent temperature of refrigerant within said first volume as a function of said refrigerant/air vapor pressure and saturation pressure/temperature characteristics of the specific type of refrigerant within said first volume, and third means coupled to said first volume for venting air from said volume when said apparent refrigerant temperature indicated by said second means is greater than said actual refrigerant temperature indicated by said first means.

2. The system set forth in claim 1 wherein said second means comprises pressure gauge means calibrated in units of temperature so as to provide said apparent temperature indicator as a function of refrigerant/air vapor pressure within said first volume.

3. The system set forth in claim 2 wherein said pressure gauge means comprises differential pressure gauge means having first and second pressure inputs, a first of said inputs being coupled to said first volume and responsive to refrigerant/air vapor pressure within said first volume, and wherein said system further comprises fourth means operatively coupled to said first volume for providing to said second pressure input a reference pressure that varies as a function of actual temperature of refrigerant within said first volume.

4. The system set forth in claim 3 wherein said fourth means comprises a second volume containing a reference refrigerant of predetermined type, and means coupled to said refrigerant feeding means externally of said first volume for passing refrigerant in said feeding means in heat-transfer contact with said second volume such that vapor pressure of said reference refrigerant in said second volume varies as a direct function of temperature of refrigerant in said feeding means.

5. The system set forth in claim 4 wherein said differential pressure gauge means further comprises means for providing said apparent temperature indication as separate functions of pressure differential between refrigerant/air vapor pressure within said first volume and reference refrigerant saturation pressure within said second volume for different refrigerant types.

6. The system set forth in claim 5 wherein said differential pressure gauge means comprises an analog gauge having an indicator needle mounted for rotation about an axis as a function of pressure differential between said first and second inputs, and means positioned adjacent to said needle bearing indicia coordinating said pressure differential to apparent temperature of refrigerant in said first volume.

7. The system set forth in claim 6 for handling refrigerants of predetermined differing types wherein said indicia comprises a plurality of indicia oriented circumferentially of said axis and respectively coordinated with saturation pressure differential between said refrigerants of differing type and said reference refrigerant versus refrigerant temperature.

8. The system set forth in claim 4 wherein said first means comprises means coupled to said second volume for providing said indication of temperature of refrigerant in said first volume as a function of vapor pressure of refrigerant in said second volume.

9. The system set forth in claim 8 wherein said first means comprises a second pressure gauge calibrated to indicate temperature as a function of refrigerant saturation pressure in said second volume.

10. The system set forth in claim 1 wherein said first means comprises means coupled to said feeding means for providing said indication of temperature of refrigerant in said first volume as a function of temperature of refrigerant in said feeding means.

11. The system set forth in claim 10 wherein said first means comprises a thermometer and means coupled to said feeding means for removably receiving said thermometer.

12. In a system for handling refrigerants of multiple predetermined types that includes a storage vessel and means for feeding refrigerant of one of said types to said vessel, means for purging air from said vessel comprising:

a refrigerant bulb containing a reference refrigerant and means positioning said bulb in heat-transfer relationship with refrigerant in said feeding means such that said reference refrigerant generates a vapor pressure coordinated with temperature of refrigerant in said feeding means, and differential pressure means having a first pressure input coupled to said vessel and a second input coupled to said bulb, said differential pressure means providing an output that indicates presence of air within said vessel as a combined function of pressure differential between said first and second inputs, respectively responsive to refrigerant/air pressure within said vessel and reference refrigerant vapor pressure within said bulb, and saturation pressure/temperature characteristics of the specific type of refrigerant in said vessel.

13. The system set forth in claim 12 wherein said differential pressure means comprises means for indicating apparent temperature of refrigerant within said vessel separately for each said predetermined refrigerant type as a function of said pressure differential.

14. The system set forth in claim 13 further comprising means for providing an indication of actual temperature of refrigerant within said vessel, and means for venting air from said vessel when said apparent temperature departs from said actual temperature.

15. The system set forth in claim 12 wherein said differential pressure means comprises an analog gauge having a needle that rotates about a fixed axis as a function of pressure differential between said inputs, and means adjacent to said needle oriented circumferentially of said axis defining scales for said refrigerants of predetermined type, said scales being calibrated in units of temperature as a function of said pressure differential.

* * * * *